United States Patent [19]

Pruyn et al.

[11] 4,383,896

[45] May 17, 1983

[54] PROCESS OF ELECTROFORMING A SCREEN, MORE PARTICULARLY A CYLINDRICAL SCREEN

[75] Inventors: Wilhelmus A. Pruyn, Hoog-Keppel; Anand Mohan, Warnsveld, both of Netherlands

[73] Assignee: Stork Screens B.V., Netherlands

[21] Appl. No.: 254,411

[22] Filed: Apr. 15, 1981

[30] Foreign Application Priority Data

Apr. 15, 1980 [NL] Netherlands ..... 80 02197

[51] Int. Cl.[3] ..... C25D 1/08; C25D 7/00

[52] U.S. Cl. ..... 204/11; 204/24

[58] Field of Search ..... 204/11, 24

[56] References Cited

U.S. PATENT DOCUMENTS

| | | | |
|---|---|---|---|
| 2,226,381 | 12/1940 | Norris | 204/24 |
| 2,226,384 | 12/1940 | Norris | 204/24 |
| 4,108,740 | 8/1978 | Wearmouth | 204/11 |

OTHER PUBLICATIONS

Modern Electroplating, Edited by Frederick A. Towenheim, 1974, pp. 296–306.

*Primary Examiner*—T. M. Tufariello

*Attorney, Agent, or Firm*—Ostrolenk, Faber, Gerb & Soffen

[57] ABSTRACT

Metal screen comprising ribs and apertures and process of electrolytically forming a metal screen by forming in a first electrolytic bath a screen skeleton upon a matrix provided with a separating agent, such as beeswax, stripping the formed screen skeleton from the matrix and subjecting the screen skeleton to an electrolysis in a second electrolytic bath in order to deposit metal onto said skeleton. The second electrolytic bath contains an organic compound having at least one unsaturated bond not belonging to a group. Preferred organic compounds are a butyne diol or an ethylene cyanohydrin. The screen is preferably a cylindrical screen.

11 Claims, 5 Drawing Figures

PROCESS OF ELECTROFORMING A SCREEN, MORE PARTICULARLY A CYLINDRICAL SCREEN

BACKGROUND OF THE INVENTION

1. Field of the Invention

The present invention relates to a process of electrolytically producing a screen by forming a screen skeleton upon a matrix in a first electrolytic bath, subsequently stripping the formed screen skeleton from the matrix and by subjecting said screen skeleton to an electrolysis in a second electrolytic bath in the presence of at least one brightener.

2. Description of the Prior Art

A process of this type for producing a screen is known in the art. In this known process, a screen skeleton is produced upon a matrix provided with a stripping means such as beeswax, the structure of said matrix corresponding with that of the screen to be produced; the screen skeleton being obtained by a deposit of metal, whereupon the thin skeleton is stripped from the matrix and is finally subjected to an electrolysis in the presence of a brightener, if any. In this process, electrolytic baths are used comprising nickel salts and eventually brighteners of the first class, the molecules of which contain a

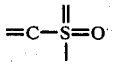

group, examples of which are e.g. sulfonic acids, mono- and dibasic sulfonic acids, sulfonic acid esters, sulfonamides, sulfonimides, sulfinic acids and sulfones.

A great drawback of said known process is that the dimensions of the lands in the screen skeleton will grow throughout by the nickel deposit, causing said lands to obtain a round cross section, which will give rise to a restriction of the size of the apertures in the screen to be produced, so that the passage of said screens is hampered.

SUMMARY OF THE INVENTION

It is therefore a primary object of the present invention to provide a process for electrolytically producing a screen, which process does not present said drawback, and in which process particularly the increase of the deposit of metal upon the screen skeleton occurs in a plane being perpendicular to the surface of the screen. It is attained in this manner that the width of the openings or apertures in the screen skeleton will decrease less rapidly, while a strong screen is formed, as the lands present in the screen skeleton are strengthened by deposits occurring perpendicular to the screen surface.

This object is achieved in accordance with the present invention in that a means is added to the second electrolytic bath, comprising at least an organic compound having at least one unsaturated bond, not belonging to a

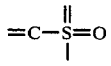

group, such that the growth of deposits perpendicular to the surface of the screen skeleton is improved.

It has appeared surprisingly that some brighteners particularly improving a strong deposit growth in the plane of the screen skeleton upon a matrix will not give rise to a particular deposit in the plane of the screen skeleton when said skeleton is placed in an electrolytic bath, but that said deposit growth will then occur in a plane perpendicular to the surface of the screen skeleton, involving all the benefits inherent therewith. Brighteners of this type are known in the art as so-called "leveling agents" or brighteners of the second class.

Very conveniently unsaturated organic compounds are used comprising at least a double or a triple bond, provided that said double or triple bond does not belong to a

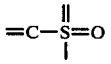

group.

Compounds which may be suitably applied in the process according to the invention, are a butyne diol or an ethylene cyanohydrin.

When the latter compounds are applied, an optimum growth of deposits upon the lands in the screen skeleton perpendicular to said screen skeleton will occur.

In a preferred embodiment of the process in accordance with the present invention, a cylindrical screen is produced by forming a screen skeleton upon a cylindrical matrix in a first electrolytic bath, by stripping said screen skeleton from the matrix and by subsequently subjecting the screen skeleton to an electrolysis in a second electrolytic bath.

On producing cylindrical screens of this type, the matrix advantageously comprises a beeswax as a stripping means.

The present invention is also embodied in a screen obtained by electrolytically forming a screen skeleton upon a matrix in a first electrolytic bath, subsequently stripping said formed screen skeleton from the matrix, and by subjecting said screen skeleton to an electrolysis in a second electrolytic bath, in the presence of at least one brightener, said screen having been obtained in that a means has been added to the second electrolytic bath, which means comprises an organic compound having at least one unsaturated bond, not belonging to a

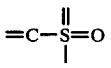

group, thus that the growth of the deposits perpendicular to the surface of the screen skeleton, is improved.

The invention particularly relates to a screen obtained by electroforming a screen skeleton upon a matrix in a first electrolytic bath, stripping said screen skeleton from said matrix, and by subjecting said screen skeleton to an electrolysis in a second electrolytic bath, in the presence of at least one brightener, whereby an organic compound is used, comprising at least a double or triple bond, provided that said double or triple bond does not belong to a

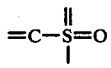

group.

Very conveniently, the abovementioned screen according to the invention is obtained by applying a butyne diol and/or ethylene cyanohydrin as the organic compound.

The invention furthermore relates to a screen, more particularly a cylindrical screen, obtained by applying the process in accordance with the present invention.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF PREFERRED EMBODIMENTS

Figure 1:
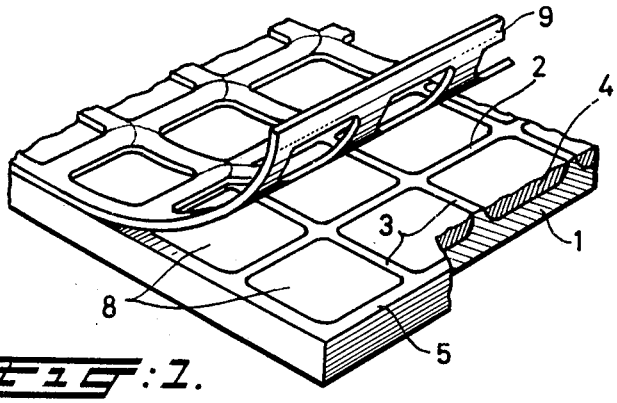
FIG. 1 is a schematic view of the manner in which a screen skeleton is stripped from a matrix.

Referring to FIG. 1 a matrix is a plate 1 of electrically conductive material, e.g. nickel is illustrated. Said plate comprises depressions 8 formed by etching, while separating said depressions by means of ribs 2, 3. The depressions 8 are filled with a di-electric material, such as e.g. an asphalt material or a bituminous material 4. More particulars of the process are disclosed in U.S. Pat. No. 2,166,366.

The separating or stripping ribs 2 and 3 have previously been provided with a layer of beeswax 5 in order to facilitate a subsequent stripping of the formed screen skeleton from the matrix.

Figure 2:
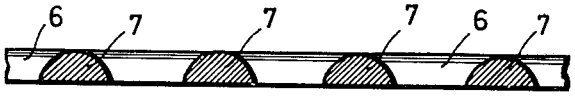
FIG. 2 is a cross section of the stripped off screen skeleton.

It will be obvious that on placing plate 1 as a cathode in an electrolytic bath, together with a suitable anode and an electric source, a deposit will be formed upon the ribs 2, 3. The dimensions of the lands thus produced in the formed screen skeleton 9 correspond to the dimensions of the ribs 2, 3. The screen skeleton formed in this manner therefore comprises lands 6 and 7 running transversely with respect to one another (see FIG. 2).

Figure 5:
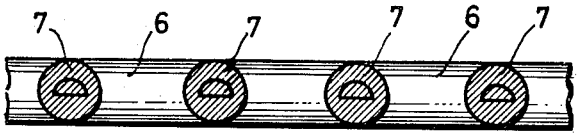
FIG. 5 is a section through a screen obtained from a screen skeleton by subjecting the screen skeleton to an electrolysis in a bath comprising nickel salts, and brighteners of the first class, if any, and not a compound according to the invention.

If the plate 1 with the screen skeleton 9 formed thereon, is subsequently placed in an electrolytic bath comprising brighteners of the first class, that is to say brighteners in the form of e.g. an alkyl naphthalene sulfonic acid, naphthalene disulfonic acids, diphenyl sulfonates or the like compounds, together with an acetylene alcohol (a compound as used in the invention) a screen is finally obtained, the lands of which preferably have been grown in the direction of the surface of the screen, while decreasing the dimensions of the openings or apertures of the screen (see FIG. 5).

Figure 3:
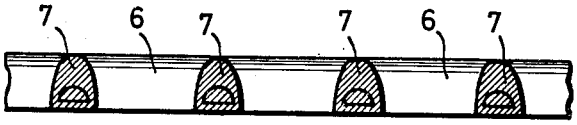
FIG. 3 is a section through a screen obtained from a screen skeleton, by subjecting said skeleton to an electrolysis in the presence of a compound, according to the present invention.
Figure 4:
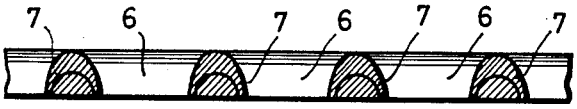
FIG. 4 is a cross section through a screen formed upon a matrix in the presence of a compound according to the invention.

When the formed screen skeleton, if the latter is still very thin as yet, is stripped from the matrix, and is suspended in an electrolytic bath, as a cathode, in the presence of an acetylene alcohol, the surprising effect can be observed that the growth of deposits upon the lands will preferably occur in a direction perpendicular to the screen skeleton surface (FIG. 3).

Similar results may also be observed with varying organic unsaturated compounds, known in the art as brighteners of the second class.

EXAMPLE I

Upon a nickel plate 1, comprising the desired screen pattern and being provided with beeswax as a separating agent, a screen skeleton is deposited by means of electrolysis. Said screen skeleton is removed when the thickness of the lands in the screen skeleton amounts to 30 micron.

The obtained screen skeleton of nickel metal is subsequently suspended in an electrolytic nickel bath as known in the art and as a cathode, subjected to an electrolysis.

Said electrolysis is carried out in the presence of an organic compound, comprising a triple bond in the molecule, apart from a

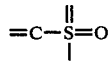

group, if present. The compound in this case consists of ethylene cyanohydrin, comprising a triple bond between the carbon and nitrogen atom.

In this manner a screen is obtained which is provided with excellent large openings, the dimensions of which are not or only slightly smaller than the openings as present in the screen skeleton.

When the experiment is repeated by placing the plate with the skeleton grown thereon, in a nickel bath, in the presence of the same compound, a screen is obtained, the thickness of which corresponds with that of the first mentioned screen, the openings of the second screen, however, being smaller, due to a deposit of nickel, preferably in the direction of the surface of the screen.

EXAMPLE II

Example I is repeated, but the plate is replaced by a cylinder, having a chromium surface. The cylindrical screen is removed when the thickness of the lands in the screen skeleton amounts for instance to 30 micron.

In this manner, a cylindrical screen is obtained comprising excellent large openings, the dimensions of which are not or only slightly smaller than those in the screen skeleton.

Although the present invention has been shown and described in connection with a preferred embodiment thereof, it will be apparent to those skilled in the art that many variations and modifications may be made without departing from the invention in its broader aspects.

It is therefore intended to have the appended claims cover all such variations and modifications as fall within the true spirit and scope of the invention.

What is claimed is:

1. Process of electrolytically producing a screen by forming a metal screen skeleton upon a matrix in a first electrolytic bath, subsequently stripping the formed screen skeleton from the matrix and subjecting said screen skeleton to an electrolysis in a second electrolytic bath in the presence of at least one brightener, wherein a means is added to the second electrolytic bath comprising a class II brightener, whereby the growth of the metal deposit perpendicular to the surface of the screen skeleton preferentially occurs.

2. Process according to claim 1, wherein the class II brightener has a double or triple bond.

3. Process according to claim 1, wherein the means is butyne diol.

4. Process according to claim 1 or 2, wherein the means is ethylene cyanohydrin.

5. Process according to claim 1, wherein a cylindrical screen is produced by forming a screen skeleton upon a cylindrical matrix in a first electrolytic bath, stripping said screen skeleton from the matrix and subsequently subjecting said screen skeleton to an electrolysis in a second electrolytic bath.

6. Process according to claim 1, wherein the screen skeleton is formed upon a matrix provided with a very thin layer of a separating agent.

7. Screen, obtained by electrolytically forming a metal screen skeleton upon a matrix in a first electrolytic bath, subsequently stripping said formed screen skeleton from the matrix and subjecting said screen skeleton to an electrolysis in a second electrolytic bath in the presence of at least one brightener, a means having been added to the second electrolytic bath, which means comprises a class II brightener whereby the growth of the metal deposit perpendicular to the surface of the screen skeleton is improved.

8. Screen, according to claim 7, wherein the class II brightener is a double or triple bond.

9. Screen according to claim 7, wherein the means is butyne diol.

10. Screen according to claim 7, wherein the means is ethylene cyanohydrin.

11. Screen according to claim 7, wherein the screen is a cylindrical screen.

* * * * *